US012123329B2

(12) United States Patent
Ali Khan et al.

(10) Patent No.: US 12,123,329 B2
(45) Date of Patent: Oct. 22, 2024

(54) ENGINE VALVE ASSEMBLY INCLUDING DETENT MECHANISM CONFIGURED TO INCREASE FORCE BIASING VALVE TOWARD CLOSED POSITION WHEN VALVE IS AT OR NEAR CLOSED POSITION

(71) Applicant: GM GLOBAL TECHNOLOGY OPERATIONS LLC, Detroit, MI (US)

(72) Inventors: Maqsood Rizwan Ali Khan, Troy, MI (US); Mark R. Claywell, Birmingham, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 121 days.

(21) Appl. No.: 17/713,707

(22) Filed: Apr. 5, 2022

(65) Prior Publication Data

US 2023/0313713 A1 Oct. 5, 2023

(51) Int. Cl.
*F01L 1/46* (2006.01)
*F01L 3/08* (2006.01)

(52) U.S. Cl.
CPC ..... *F01L 1/462* (2013.01); *F01L 3/08* (2013.01)

(58) Field of Classification Search
CPC ..... F01L 1/462; F01L 3/08; F16K 1/00
See application file for complete search history.

(56) References Cited

U.S. PATENT DOCUMENTS 2,841,128 A * 7/1958 Aiken ..... F01L 1/32 123/90.67
5,245,957 A * 9/1993 Bornstein ..... F01L 1/047 123/90.26
5,544,628 A * 8/1996 Voigt ..... F01L 1/462 123/90.39
5,823,158 A * 10/1998 Heimann, Jr. ..... F01L 3/06 29/888.04
6,811,143 B2 * 11/2004 Creissel ..... F01L 1/462 251/337
8,056,520 B2 * 11/2011 Elendt ..... F01L 3/10 123/90.24
9,885,260 B2 * 2/2018 Martin ..... F01L 1/462

FOREIGN PATENT DOCUMENTS

JP 2010216567 A * 9/2010 ..... F01L 1/462

* cited by examiner

*Primary Examiner* — Grant Moubry
*Assistant Examiner* — James G Moubry

(57) ABSTRACT

A valve assembly includes a valve body defining a bore therein, a valve stem, a spring retainer, a valve spring, and a detent mechanism. The valve stem extends through the bore in the valve body and is adjustable between an open position and a closed position. The spring retainer is spaced apart from the valve body along a longitudinal axis of the valve stem and fixed relative to the valve body. The spring retainer defines a bore through which the valve stem extends. The valve spring is captured between the valve body and the spring retainer and is configured to apply a biasing force to the valve stem that biases the valve stem toward the closed position. The detent mechanism is configured to increase the biasing force applied to the valve stem when the valve stem is in the closed position or within a predetermined distance of the closed position.

18 Claims, 4 Drawing Sheets

ENGINE VALVE ASSEMBLY INCLUDING DETENT MECHANISM CONFIGURED TO INCREASE FORCE BIASING VALVE TOWARD CLOSED POSITION WHEN VALVE IS AT OR NEAR CLOSED POSITION

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

The present disclosure relates to engine valve assemblies including a detent mechanism configured to increase a force biasing a valve toward its closed position when the valve is at or near its closed position.

An intake or exhaust valve of an engine typically includes a valve body, a valve stem, a valve head, a valve guide, a valve spring, and a spring retainer. The valve body defines a hole through which intake air or exhaust gas flows. The valve stem is a rod, and the valve head is a disk attached to one end of the rod. The valve stem and the valve head are referred to collectively as a poppet valve. The valve head seats against a valve seat defined by the valve body and plugs the hole therein to prevent gas flow through the hole when the poppet valve is in its closed position.

The valve guide maintains the valve stem and head structure in alignment with the valve seat. The valve spring biases the poppet valve toward its closed position. The spring retainer is spaced apart from the valve body along the longitudinal axis of the valve stem. The valve spring is captured between the valve body and the spring retainer.

SUMMARY

A valve assembly for a cylinder of an engine is described herein. In one example, the valve assembly includes a valve body, a valve stem, a spring retainer, a valve spring and a detent mechanism. The valve body defines a bore therein. The valve stem extends through the bore in the valve body. The valve stem is adjustable between an open position and a closed position. The spring retainer is spaced apart from the valve body along a longitudinal axis of the valve stem and fixed relative to the valve body. The spring retainer defines a bore through which the valve stem extends. The valve spring is captured between the valve body and the spring retainer and is configured to apply a biasing force to the valve stem that biases the valve stem toward the closed position. The detent mechanism is configured to increase the biasing force applied to the valve stem when the valve stem is in the closed position or within a predetermined distance of the closed position.

In one aspect, the detent mechanism includes an annular groove formed in an outer radial surface of the valve stem and extending around a circumference thereof, and a cup spring fixed relative to the valve body and disposed about the circumference of the valve stem radially outward of the annular groove therein.

In one aspect, the valve assembly further includes ball detents captured between the valve stem and the cup spring. The ball detents engage the annular groove in the valve stem when the valve stem is in the closed position or within the predetermined distance of the closed position.

In one aspect, the valve assembly further includes a valve seal attached to an axial end surface of the valve body and engaging the outer radial surface of the valve stem. One end of the cup spring is attached to an outer radial surface of the valve seal and the other end of the cup spring captures the ball detents.

In one aspect, a width of the annular groove is greater than a diameter of the ball detents.

In one aspect, the annular groove has a ramped profile extending from a bottom surface of the annular groove to the outer radial surface of the valve stem. The ball detents engage the ramped profile as the valve stem is moved from the closed position toward the open position.

In one aspect, the cup spring forms an annular rib that engages the annular groove in the valve stem when the valve stem is in the closed position or within the predetermined distance of the closed position.

In one aspect, the valve assembly further includes a valve seal attached to an axial end surface of the valve body and engaging the outer radial surface of the valve stem. One end of the cup spring is attached to an outer radial surface of the valve seal and the other end of the cup spring forms the annular rib.

In one aspect, the cup spring includes a hollow cylindrical section attached to the outer radial surface of the valve seal and a hollow conical frustum section extending radially inward from the hollow cylindrical section to the annular rib formed by the cup spring. The annular rib projects radially inward from the hollow conical frustum section.

In one aspect, the detent mechanism includes an annular groove formed in an outer radial surface of the valve stem and extending around a circumference thereof, a valve seal attached to the valve body and engaging the outer radial surface of the valve stem, and a garter spring engaging an outer radial surface of the valve seal and extending around a circumference thereof. The garter spring biases the valve seal into engagement with the annular groove in the valve stem when the valve stem is in the closed position or within the predetermined distance of the closed position.

In one aspect, the valve seal includes a seal body and a seal lip. The seal body is attached to an axial end surface of the valve body and disposed about the circumference of the valve stem. The seal lip attached to an inner radial surface of the seal body projects radially inward therefrom and engages the outer radial surface of the valve stem. The garter spring engages the outer radial surface of the seal lip.

In one aspect, the valve assembly further includes a valve guide having a hollow cylindrical body including a first portion disposed radially between the valve stem and the valve body and a second portion disposed radially between the valve seal and the valve stem.

In one aspect, the predetermined distance is less than 25 percent of a peak lift of the valve stem.

In another example, the valve assembly includes a valve body, a valve stem, a spring retainer, a valve spring, a cup spring, and at least one detent. The valve body defines a bore therein. The valve stem extends through the bore in the valve body and has an outer radial surface with an annular groove formed therein. The valve stem is adjustable between an open position and a closed position. The spring retainer is spaced apart from the valve body along a longitudinal axis of the valve stem and is fixed relative to the valve body. The spring retainer defines a bore through which the valve stem extends. The valve spring is captured between the valve body and the spring retainer and is configured to apply a biasing force to the valve stem that biases the valve stem toward the closed position. The cup spring is fixed relative to the valve body and disposed about a circumference of the valve stem radially outward of the annular groove therein. The at least one detent engages the annular groove in the valve stem when the valve stem is in the closed position, and thereby inhibits movement of the valve stem from the closed position toward the open position.

In one aspect, the at least one detent includes ball detents captured between the valve stem and the cup spring.

In one aspect, the cup spring includes a ring-shaped section that captures the ball detents.

In one aspect, the at least one detent includes an annular rib formed by the cup spring.

In one aspect, the annular groove has a ramped profile extending from a bottom surface of the annular groove to the outer radial surface of the valve stem, and the at least one detent engages the ramped profile as the valve stem is moved from the closed position toward the open position.

In another example, the valve assembly includes a valve body, a valve stem, a spring retainer, a valve spring, a valve seal, and a garter spring. The valve body defines a bore therein. The valve stem extends through the bore in the valve body. The valve stem has an outer radial surface with an annular groove formed therein. The valve stem is adjustable between an open position and a closed position. The spring retainer is spaced apart from the valve body along a longitudinal axis of the valve stem and fixed relative to the valve body. The spring retainer defines a bore through which the valve stem extends. The valve spring is captured between the valve body and the spring retainer and is configured to apply a biasing force to the valve stem that biases the valve stem toward the closed position. The valve seal is attached to the valve body and engages the outer radial surface of the valve stem. The garter spring engages an outer radial surface of the valve seal and extends around a circumference thereof. The garter spring biases the valve seal into engagement with the annular groove in the valve stem. The engagement between the valve seal and the annular groove inhibits movement of the valve stem from the closed position toward the open position.

In one aspect, the valve seal includes a seal body and a seal lip. The seal body is attached to an axial end surface of the valve body and disposed about a circumference of the valve stem. The seal lip is attached to an inner radial surface of the seal body, projects radially inward therefrom, and engages the outer radial surface of the valve stem. The garter spring engages the outer radial surface of the seal lip.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

During compression release engine braking, exhaust valves of cylinders are opened just before the compression strokes of the cylinders end, which releases the compressed gas trapped in the cylinders and thereby slows a vehicle. This process yields high exhaust gas pressure, which can cause an exhaust valve to open independent of a valve actuator that controls the position of the exhaust valve. Engine braking by restricting exhaust gas flow and/or increasing boost pressure can also yield high exhaust gas pressure, and therefore can also cause an exhaust valve to open independent of its valve actuator. A poppet valve may open independent of its valve actuator if the biasing force of the valve spring is less than the difference between the force of the exhaust gas acting on the backside of the poppet valve and the force of compressed gas acting on the cylinder side of the poppet valve. While this issue may be addressed by increasing the rate of the valve spring, increasing the rate of the valve spring decreases engine efficiency.

A valve assembly according to the present disclosure includes a detent mechanism that addresses the above issue without decreasing engine efficiency. The detent mechanism increases the biasing force urging the poppet valve toward its closed position only when the poppet valve is at or near its closed position, which prevents the poppet valve from opening independent from its valve actuator even when the engine is operating at a high load and a high speed. Conversely, when the poppet valve is away from its closed position, the detent mechanism does not affect the force applied by the valve actuator to open the poppet valve.

In one example, the detent mechanism includes an annular groove in the valve stem, ball detents, and a cup spring that biases the ball detents into engagement with the annular groove when the poppet valve is at or near its closed position. In another example, the detent mechanism includes the annular groove in the valve stem and the cup spring, and one end of the cup spring forms an annular rib that engages the annular groove when the poppet valve is at or near its closed position. In yet another example, the detent mechanism includes the annular groove in the valve stem, a valve seal, and a garter spring that compresses the valve seal into the annular groove when the poppet valve is at or near its closed position.

Figure 2:
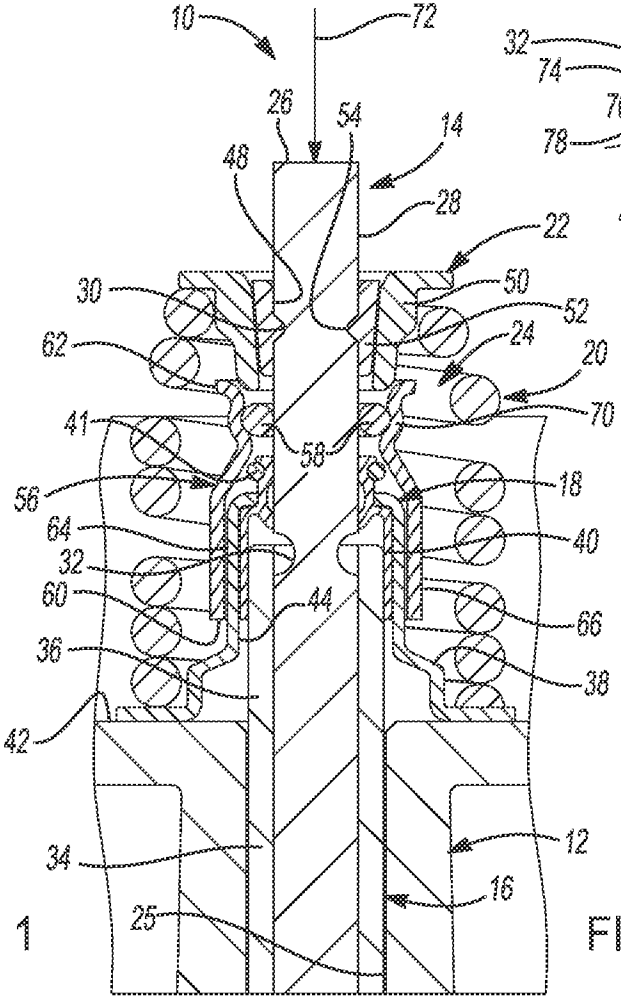
FIG. 2 is a section view of the valve assembly of FIG. 1 with the valve stem shown in its open position.
Figure 1:
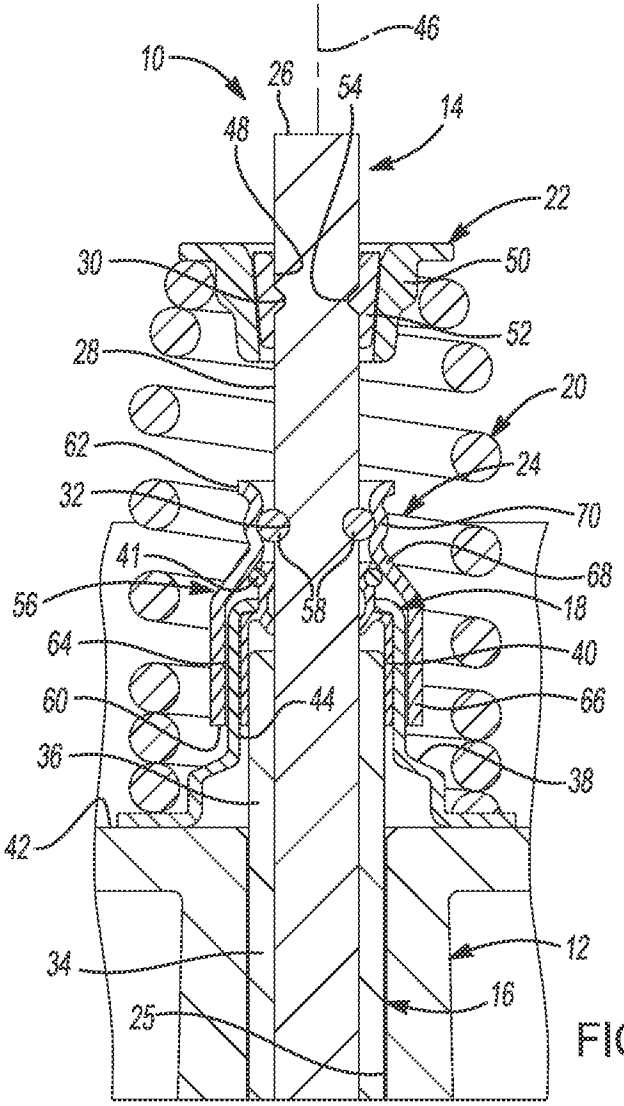
FIG. 1 is a section view of a valve assembly including a valve stem shown in its closed position, a valve spring, and an example of a detent mechanism according to the present disclosure.

Referring now to FIGS. 1 and 2, a valve assembly 10 may be an intake or exhaust valve of an engine. The valve assembly 10 includes a valve body 12, a valve stem 14, a valve guide 16, a valve seal 18, a valve spring 20, a spring retainer 22, and a detent mechanism 24. The valve body 12 defines a bore 25 through which the valve stem 14 extends.

The valve body 12 may be part of a cylinder head of the engine. The cylinder head may be placed on top of an engine block (not shown) that defines cylinders of the engine. The valve body 12 may be made from aluminum.

The valve stem 14 is adjustable between a closed position (FIG. 1) and an open position (FIG. 2). The valve stem 14 has a cylindrical body with an upper end 26, a lower end (not shown) opposite of the upper end 26, and an outer radial surface 28. A valve head (not shown) is joined to the lower end of the valve stem 14. The valve head may be disk shaped. When the valve stem 14 is in its closed position as shown in FIG. 1, the valve head seats against a valve seat defined by the cylinder head to prevent gas flow into or out of one of the cylinders. When the valve stem 14 is in its open position as shown in FIG. 2, the valve head seats against a valve seat defined by the cylinder head to prevent gas flow into or out of the one cylinder.

The outer radial surface 28 of the valve stem 14 has first and second annular grooves 30 and 32 formed therein and extending around the circumference thereof. The first annular groove 30 in the valve stem 14 receives a portion of the spring retainer 22. The engagement between the spring retainer 22 and the first annular groove 30 in the valve stem 14 secures the spring retainer 22 to the valve stem 14. The second annular groove 32 in the valve stem 14 receives a portion of the detent mechanism 24.

The valve stem 14 translates through the valve guide 16 as the valve stem 14 actuates between its open and closed positions. The valve guide 16 maintains the valve stem 14 in alignment with the bore 25 in the valve body 12. In addition, the valve guide 16 acts as a bushing by minimizing wear on the valve body 12 and the valve stem 14 as the valve stem 14 actuates between its open and closed positions. The valve stem 14 and the valve guide 16 may be made from steel.

The valve guide 16 has a hollow cylindrical body with a first portion 34 and a second portion 36. The first portion 34 of the valve guide 16 is disposed in the bore 25 in the valve body 12 and radially between the valve stem 14 and the valve body 12. The second portion 36 of the valve guide 16 is disposed outside of the bore 25 in the valve body 12 and radially between the valve seal 18 and the valve stem 14. The valve guide 16 may be pressed into the bore 25 in the valve body 12.

The valve seal 18 seals the interface between the valve body 12 and the valve stem 14. The valve seal 18 includes a seal body 38, a seal lip 40, and a garter spring 41. The seal body 38 is attached (e.g., welded) to an axial end surface 42 of the valve body 12 and is disposed about the circumference of the valve stem 14. The seal body 38 is made from a rigid material such as steel. The seal lip 40 is attached to an inner radial surface 44 of the seal body 38 and projects radially inward therefrom. The seal lip 40 is made from a flexible material such as rubber and may be over molded to the seal body 38. The garter spring 41 biases the seal lip 40 into engagement with the outer radial surface 28 of the valve stem 14.

The valve spring 20 applies a biasing force to the valve stem 14 that biases the valve stem 14 toward its closed position. The valve spring 20 is captured between the valve body 12 (or the valve seal 18) and the spring retainer 22. The valve spring 20 is a coil spring made from a metal such as steel.

The spring retainer 22 retains the valve spring 20. The spring retainer 22 is spaced apart from the valve body 12 along a longitudinal axis 46 of the valve stem 14 and is fixed relative to the valve body 12. The spring retainer 22 defines a bore 48 through which the valve stem 14 extends.

The spring retainer 22 includes a retainer body 50 and a keeper 52. The retainer body 50 is made from a rigid material such as steel. The keeper 52 is made from a flexible material such as rubber and may be over molded to the retainer body 50. The keeper 52 may have a cylindrical shape in its relaxed state. When the spring retainer 22 is assembled to the valve stem 14, the keeper 52 is compressed between the retainer body 50 and the valve stem 14. In turn, the keeper 52 includes an annular protrusion 54 that engages the first annular groove 30 in the valve stem 14 and thereby secures the spring retainer 22 to the valve stem 14.

The detent mechanism 24 increases the biasing force urging the valve stem 14 toward its closed position when the valve stem 14 is in its closed position or within a predetermined distance of its closed position. In one example, the predetermined distance is less than 25 percent of the peak lift of the valve stem 14 (and the valve head joined thereto). In another example, the predetermined distance is less than 2 millimeters (mm). The detent mechanism 24 includes the second annular groove 32 in the valve stem 14, a cup spring 56, and ball detents 58.

The cup spring 56 is fixed relative to the valve body 12 and is disposed about the circumference of the valve stem 14 radially outward of the second annular groove 32 therein. The cup spring 56 has a first end 60 and a second end 62 opposite of the first end 60. The first end 60 of the cup spring 56 is attached to an outer radial surface 64 of the valve seal 18. The second end 62 of the cup spring 56 captures the ball detents 58 and applies a biasing force to the ball detents 58 that urges the ball detents 58 into engagement with the second annular groove 32 in the valve stem 14. The cup spring 56 may be made from a metal such as steel.

The cup spring 56 includes a hollow cylindrical section 66, a hollow conical frustum section 68, and a ring-shaped section 70. The hollow cylindrical section 66 extends along the longitudinal axis 46 of the valve stem 14 from the first end 60 of the cup spring 56 to the hollow conical frustum section 68. The hollow conical frustum section 68 extends along the longitudinal axis 46 of the valve stem 14 from the hollow cylindrical section 66 to the ring-shaped section 70. The ring-shaped section 70 extends along the longitudinal axis 46 of the valve stem 14 from the hollow cylindrical section 66 to the second end 62 of the cup spring 56. The ring-shaped section 70 captures the ball detents 58.

The ball detents 58 engage the second annular groove 32 in the valve stem 14 when the valve stem 14 is in its closed position, and thereby inhibit movement of the valve stem 14 from its closed position toward its open position. Although only two ball detents 58 are shown, the detent mechanism 24 may include more than two ball detents 58, and the ball detents 58 may be disposed about the entire circumference of the valve stem 14. Each ball detent 58 has a spherical shape and may be made from a metal such as steel.

A valve actuator (not shown) moves the valve stem 14 in a downward direction 72 to adjust the valve stem 14 from its closed position (FIG. 1) to its open position (FIG. 2). In doing so, the valve actuator compresses the valve spring 20 and thereby overcomes the biasing force applied by the valve spring 20 urging the valve stem 14 toward its closed position. In addition, the valve actuator moves the ball detents 58 radially outward out of the second annular groove 32 in the valve stem 14 and thereby overcomes the biasing force applied by the cup spring 56 urging the ball detents 58 into engagement with the second annular groove 32.

Once the ball detents 58 are out of the second annular groove 32 in the valve stem 14, the detent mechanism 24 does not increase the biasing force urging the valve stem 14 toward its closed position. Thus, the detent mechanism 24 increases the biasing force urging the valve stem 14 toward its closed position only when the valve stem 14 is in its closed position or within the predetermined distance thereof. The predetermined distance may be equal to the amount that the valve stem 14 travels between its closed position and the position in which the ball detents 58 are initially removed from the second annular groove 32 in the valve stem 14.

In the example shown in FIGS. 1 and 2, the radius of the second annular groove 32 in valve stem 14 is equal to, or nearly equal to, the radius of each ball detent 58. Thus, the ball detents 58 may not engage the second annular groove 32 in valve stem 14 when the valve stem 14 is in its closed position due to manufacturing tolerances. In the example shown in FIG. 3, the second annular groove 32 in valve stem 14 has a different radius than each ball detent 58. More specifically, the second annular groove 32 in valve stem 14 has a width W that is greater than a diameter D of each ball detent 58 to absorb manufacturing tolerances.

In addition, the second annular groove 32 in valve stem 14 has a ramped profile 74 extending in from a bottom surface 76 of the second annular groove 32 to the outer radial surface 28 of the valve stem 14. The ball detents 58 engage the ramped profile 74 as the valve stem 14 is moved from its closed position toward its open position. Furthermore, the second annular groove 32 in valve stem 14 has a ramped profile 78 extending from the bottom surface 76 of the second annular groove 32 to the outer radial surface 28 of the valve stem 14 in an opposite direction than the ramped profile 74.

At least a portion of the ramped profile 74 of the second annular groove 32 in the valve stem 14 is oriented at a first angle A1 relative to the outer radial surface 28 of the valve stem 14. Increasing the first angle A1 of the ramped profile 74 causes the detent mechanism 24 to apply a greater biasing force urging the valve stem 14 toward its closed position while providing less ability to accommodate manufacturing tolerances. Decreasing the first angle A1 of the ramped profile 74 has the opposite effects. In one example, the first angle A1 of the ramped profile 74 is within a range between 35 degrees and 55 degrees (e.g., 45 degrees).

At least a portion of the ramped profile 78 of the second annular groove 32 in valve stem 14 is oriented at a second angle A2 relative to the outer radial surface 28 of the valve stem 14. Thus, the force required to move the ball detents 58 out of the second annular groove 32 in the downward direction 72 is greater than the force required to move the ball detents 58 out of the second annular groove 32 in the opposite, upward direction. This prevents the ball detents 58 from moving in the downward direction 72 past the second annular groove 32 in the valve stem 14 and damaging the valve seal 18.

The ramped profiles 74, 78 of the second annular groove 32 in the valve stem 14 and the bottom surface 76 of the second annular groove 32 form the entire profile of the second annular groove 32. No section of the profile of the second annular groove 32 is parallel to the longitudinal axis 46 of the valve stem 14. Thus, the bottom surface 76 of the second annular groove 32 is not flat. As a result, the detent mechanism 24 increases the biasing force urging the valve stem 14 toward its closed position throughout the entire engagement between the ball detents 58 and the second annular groove 32 in the valve stem 14.

Figure 4:
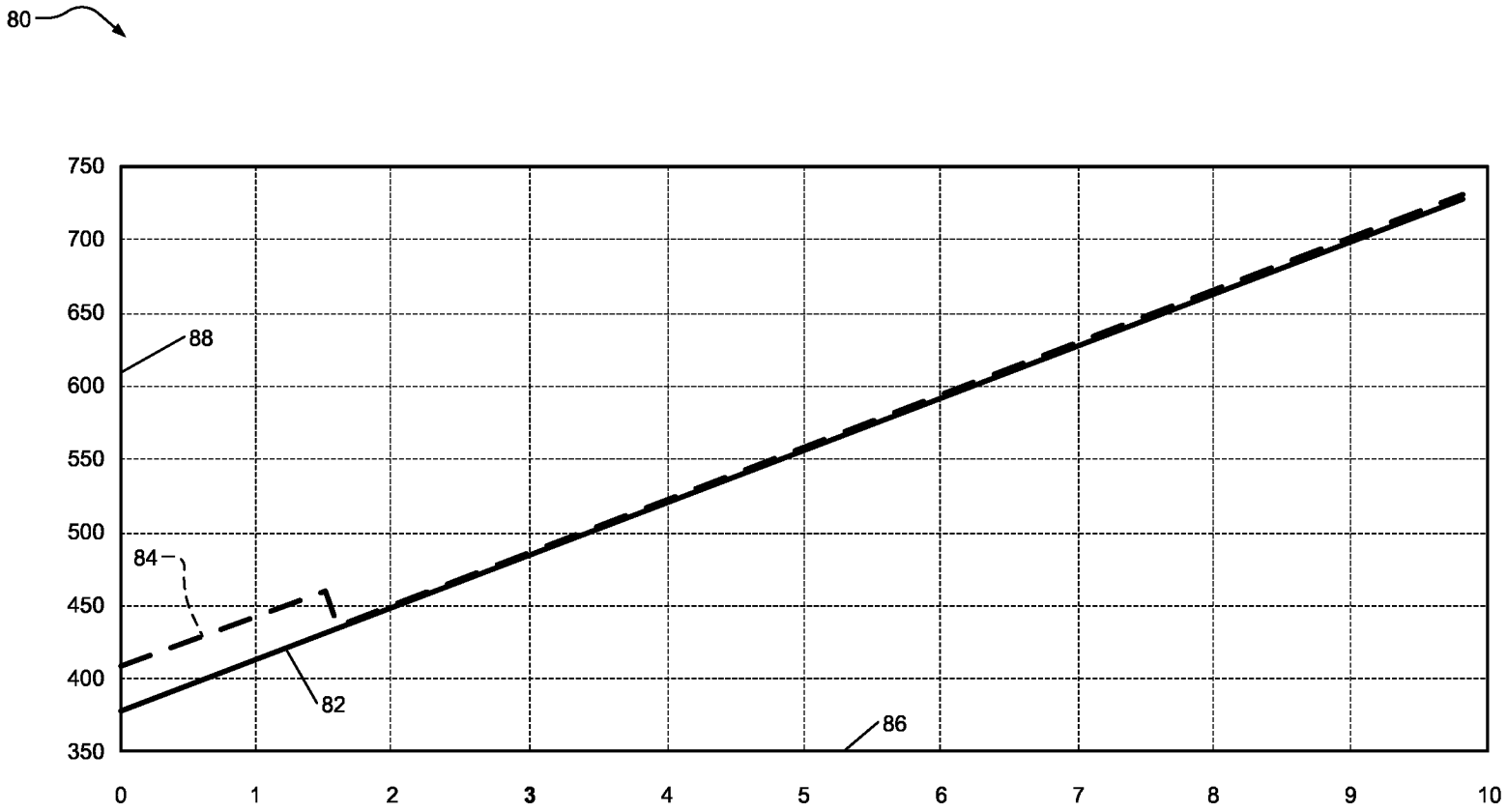
FIG. 4 is a graph illustrating a biasing force applied by the valve spring and the detent mechanism that urges the valve stem toward its closed position.

Referring now to FIG. 4, a graph 80 illustrates example biasing forces 82, 84 urging the valve stem 14 toward its closed position. The biasing force 82 represents the biasing force applied by the valve spring 20 by itself. The biasing force 84 represents the biasing force applied by the valve spring 20 and the detent mechanism 24. The biasing forces 82, 84 are plotted with respect to an x-axis 86 the represents valve lift in mm and a y-axis 88 that represents force in newtons (N).

At a valve lift of 0 mm, the biasing force 82 is approximately 380 N, and the biasing force 84 is approximately 410 N. Thus, the detent mechanism 24 increases the biasing force urging the valve stem 14 toward its closed position by approximately 30 N. As the valve stem 14 is moved from its closed position toward its open position, the detent mechanism 24 continues to increase this biasing force by approximately 30 N until the valve lift is approximately 1.5 mm. At that point, the detent mechanism 24 stops increasing the biasing force urging the valve stem 14 toward its closed position, and the biasing forces 82, 84 are equal to one another.

Figure 6:
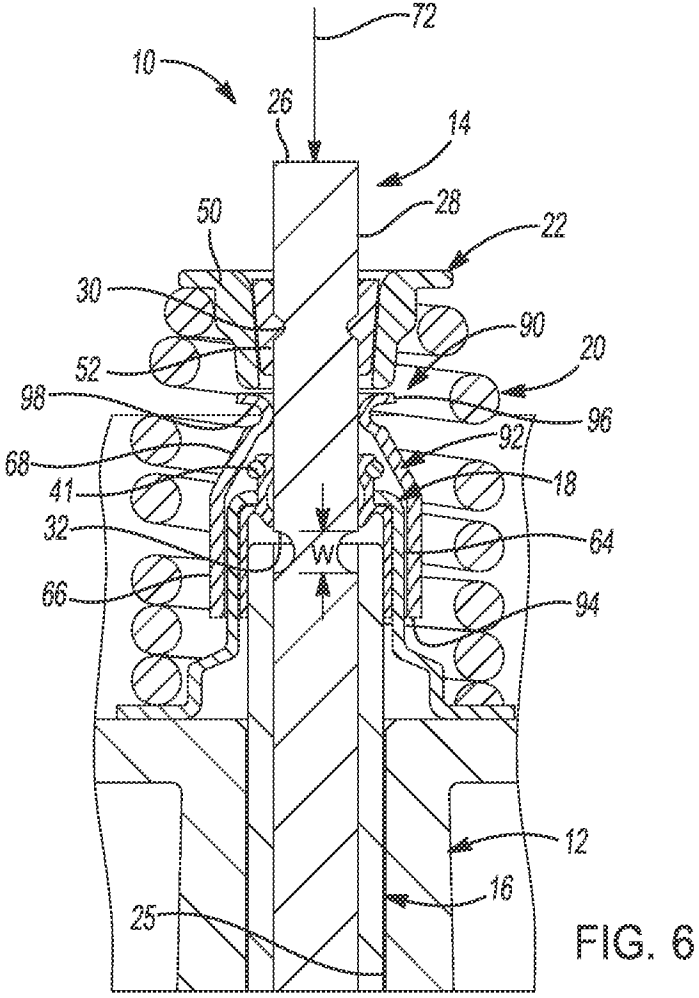
FIG. 6 is a section view of the valve assembly of FIG. 5 with the valve stem shown in its open position.
Figure 5:
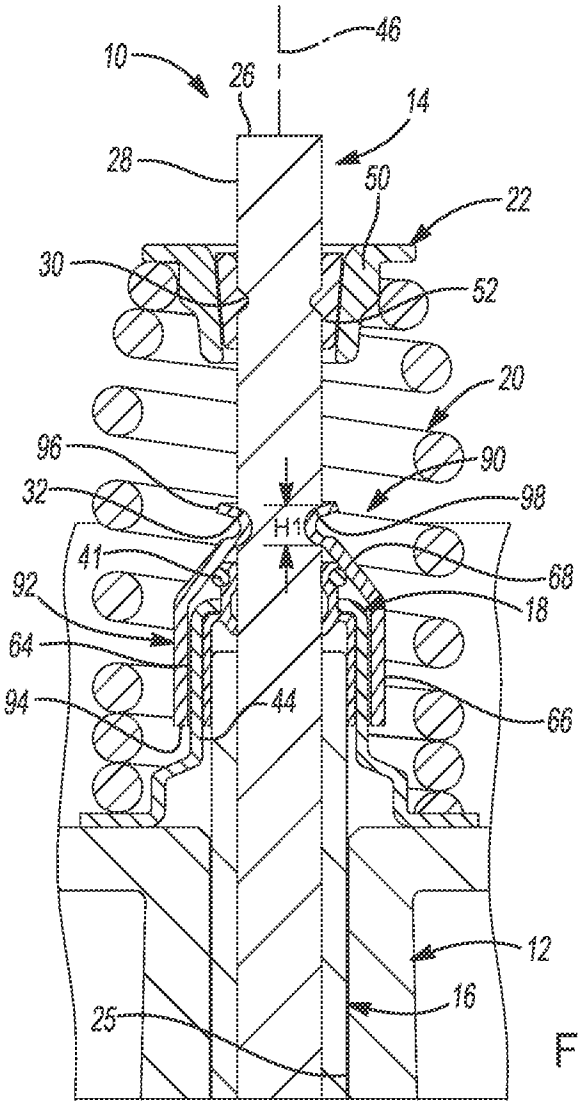
FIG. 5 is a section view of a valve assembly including a valve stem shown in its closed position and another example of a detent mechanism according to the present disclosure.

Referring now to FIGS. 5 and 6, the valve assembly 10 is shown with a detent mechanism 90 in place of the detent mechanism 24. The detent mechanism 90 includes the second annular groove 32 in the valve stem 14 and a cup spring 92. The cup spring 92 has a first end 94 and a second end 96 opposite of the first end 94. The first end 94 of the cup spring 92 is attached to the outer radial surface 28 of the valve seal 18. Like the cup spring 56, the cup spring 92 includes the hollow cylindrical section 66 and the hollow conical frustum section 68. In contrast to the detent mechanism 24, the detent mechanism 90 does not include the ball detents 58, and the cup spring 92 does not include the ring-shaped section 70 that captures the ball detents 58. Instead, the second end 96 of the cup spring 92 forms an annular rib 98 that engages the outer radial surface 28 of the valve stem 14.

Figure 3:
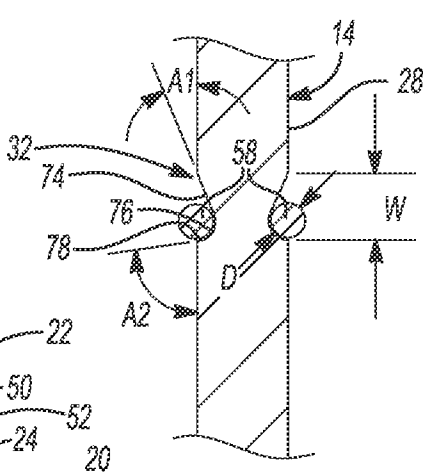
FIG. 3 is a section view of a portion of a variation of the valve assembly of FIG. 1 with the valve stem defining an annular groove having a ramped profile.

The hollow conical frustum section 68 of the cup spring 92 biases the annular rib 98 into engagement with the second annular groove 32 in the valve stem 14 when the valve stem 14 is in its closed position or within the predetermined distance thereof. The engagement between the annular rib 98 and the second annular groove 32 inhibits movement of the valve stem 14 from its closed position toward its open position. The cup spring 92 may be made from a metal such as steel. In the example shown in FIGS. 5 and 6, the second annular groove 32 in the valve stem 14 has a hemispherical profile with a radius that is approximately equal to the radius of the annular rib 98. In other examples, the second annular groove 32 in the valve stem 14 may have a ramped profile as shown in the example of FIG. 3, and the width W of the second annular groove 32 may be greater than a height H1 of the annular rib 98.

Figure 8:
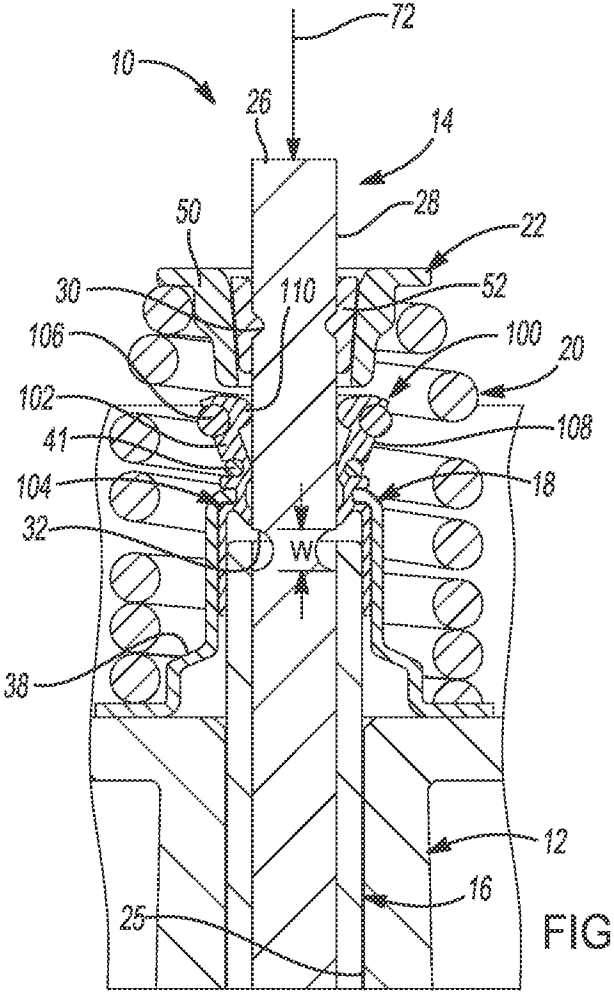
FIG. 8 is a section view of the valve assembly of FIG. 7 with the valve stem shown in its open position.
Figure 7:
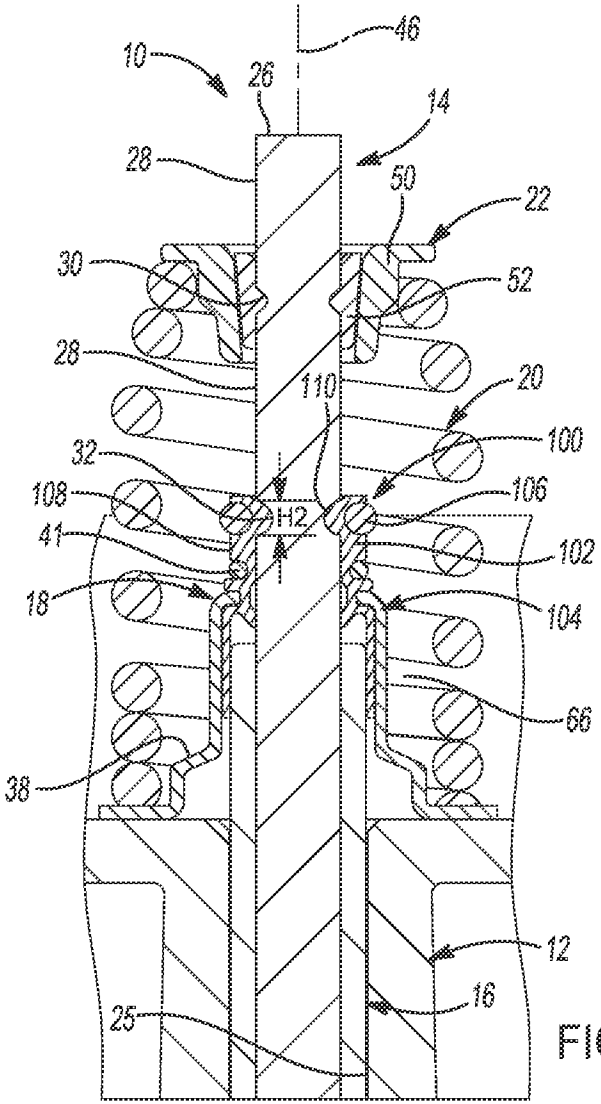
FIG. 7 is a section view of a valve assembly including a valve stem shown in its closed position and yet another example of a detent mechanism according to the present disclosure.

Referring now to FIGS. 7 and 8, the valve assembly 10 is shown with a detent mechanism 100 in place of the detent mechanism 24. The detent mechanism 100 includes the second annular groove 32 in the valve stem 14, an upper portion 102 of a seal lip 104, and a garter spring 106. Like the seal lip 40, the seal lip 104 is attached to the inner radial surface 44 of the seal body 38 and projects radially inward therefrom, the seal lip 104 is made from a flexible material, such as rubber, and the seal lip 104 may be over molded to the seal body 38. In contrast to the seal lip 40, the seal lip 104 includes the upper portion 102, which projects in the upward direction from the portion of the seal lip 104 that corresponds to the seal lip 40.

The garter spring 106 engages an outer radial surface 108 of the seal lip 104 and extends around the circumference thereof. The garter spring 106 biases the seal lip 104 into engagement with the second annular groove 32 in the valve stem 14 when the valve stem 14 is in its closed portion or within the predetermined distance thereof. The garter spring 106 may be made from steel. In various implementations, the garter springs 41, 106 may be replaced with a single garter spring.

The upper portion 102 of the seal lip 104 may have a cylindrical shape in its relaxed state. When the garter spring 106 engages the outer radial surface 108 of the seal lip 104, the garter spring 106 compresses the seal lip 104 radially inward and thereby forms an annular protrusion 110 in the upper portion 102 of the seal lip 104. The annular protrusion 110 on the seal lip 104 projects radially inward from the remainder of the upper portion 102 of the seal lip 104. The annular protrusion 110 on the seal lip 104 engages the second annular groove 32 in the valve stem 14 when the valve stem 14 is in its closed position, and thereby inhibits movement of the valve stem 14 from its closed position toward its open position. In the example shown in FIGS. 7 and 8, the second annular groove 32 in the valve stem 14 has a hemispherical profile with a radius that is approximately equal to the radius of the annular protrusion 110. In other examples, the second annular groove 32 in the valve stem 14 may have a ramped profile as shown in the example of FIG. 3, and the width W of the second annular groove 32 may be greater than a height H2 of the annular protrusion 110.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

As used herein, the term "and/or" includes any and all combinations of one or more of the associated listed items. As used herein, the phrase at least one of A, B, and C should be construed to mean a logical (A OR B OR C), using a non-exclusive logical OR, and should not be construed to mean "at least one of A, at least one of B, and at least one of C."

What is claimed is:

1. A valve assembly for a cylinder of an engine, the valve assembly comprising:

a valve body defining a bore therein;

a valve stem extending through the bore in the valve body, wherein the valve stem is adjustable between an open position and a closed position;

a spring retainer spaced apart from the valve body along a longitudinal axis of the valve stem and fixed relative to the valve body, the spring retainer defining a bore through which the valve stem extends;

a valve spring captured between the valve body and the spring retainer and configured to apply a biasing force to the valve stem that biases the valve stem toward the closed position; and a detent mechanism configured to increase the biasing force applied to the valve stem when the valve stem is in the closed position or within a predetermined distance of the closed position, wherein the detent mechanism includes:

an annular groove formed in an outer radial surface of the valve stem and extending around a circumference thereof;

a valve seal attached to the valve body and engaging the outer radial surface of the valve stem; and a garter spring engaging an outer radial surface of the valve seal and extending around a circumference thereof, the garter spring biasing the valve seal into engagement with the annular groove in the valve stem when the valve stem is in the closed position or within the predetermined distance of the closed position.

2. The valve assembly of claim 1 wherein the detent mechanism further includes:

a cup spring fixed relative to the valve body and disposed about the circumference of the valve stem radially outward of the annular groove therein.

3. The valve assembly of claim 2 further comprising ball detents captured between the valve stem and the cup spring, wherein the ball detents engage the annular groove in the valve stem when the valve stem is in the closed position or within the predetermined distance of the closed position.

4. The valve assembly of claim 3 further comprising a valve seal attached to an axial end surface of the valve body and engaging the outer radial surface of the valve stem, wherein one end of the cup spring is attached to an outer radial surface of the valve seal and the other end of the cup spring captures the ball detents.

5. The valve assembly of claim 3 wherein a width of the annular groove is greater than a diameter of the ball detents.

6. The valve assembly of claim 3 wherein the annular groove has a ramped profile extending from a bottom surface of the annular groove to the outer radial surface of the valve stem, the ball detents engaging the ramped profile as the valve stem is moved from the closed position toward the open position.

7. The valve assembly of claim 2 wherein the cup spring forms an annular rib that engages the annular groove in the valve stem when the valve stem is in the closed position or within the predetermined distance of the closed position.

8. The valve assembly of claim 7 wherein the valve seal is attached to an axial end surface of the valve body and engages the outer radial surface of the valve stem, wherein one end of the cup spring is attached to an outer radial surface of the valve seal and the other end of the cup spring forms the annular rib.

9. The valve assembly of claim 8 wherein the cup spring includes a hollow cylindrical section attached to the outer radial surface of the valve seal and a hollow conical frustum section extending radially inward from the hollow cylindrical section to the annular rib formed by the cup spring, the annular rib projecting radially inward from the hollow conical frustum section.

10. The valve assembly of claim 1 wherein the valve seal includes:

a seal body attached to an axial end surface of the valve body and disposed about the circumference of the valve stem; and a seal lip attached to an inner radial surface of the seal body, projecting radially inward therefrom, and engaging the outer radial surface of the valve stem, wherein the garter spring engages the outer radial surface of the seal lip.

11. The valve assembly of claim 1 further comprising a valve guide having a hollow cylindrical body including a first portion disposed radially between the valve stem and the valve body and a second portion disposed radially between the valve seal and the valve stem.

12. The valve assembly of claim 1 wherein the predetermined distance is less than 25 percent of a peak lift of the valve stem.

13. A valve assembly for a cylinder of an engine, the valve assembly comprising:

a valve body defining a bore therein;

a valve stem extending through the bore in the valve body, the valve stem having an outer radial surface with an annular groove formed therein, wherein the valve stem is adjustable between an open position and a closed position;

a spring retainer spaced apart from the valve body along a longitudinal axis of the valve stem and fixed relative to the valve body, the spring retainer defining a bore through which the valve stem extends;

a valve spring captured between the valve body and the spring retainer and configured to apply a biasing force to the valve stem that biases the valve stem toward the closed position;

a cup spring fixed relative to the valve body and disposed about a circumference of the valve stem radially outward of the annular groove therein; and at least one detent that engages the annular groove in the valve stem when the valve stem is in the closed position, and thereby inhibits movement of the valve stem from the closed position toward the open position, wherein the at least one detent includes an annular rib formed by the cup spring.

14. The valve assembly of claim 13 wherein the at least one detent includes ball detents captured between the valve stem and the cup spring.

15. The valve assembly of claim 14 wherein the cup spring includes a ring-shaped section that captures the ball detents.

16. The valve assembly of claim 13 wherein the annular groove has a ramped profile extending from a bottom surface of the annular groove to the outer radial surface of the valve stem, the at least one detent engaging the ramped profile as the valve stem is moved from the closed position toward the open position.

17. A valve assembly for a cylinder of an engine, the valve assembly comprising:

a valve body defining a bore therein;

a valve stem extending through the bore in the valve body, the valve stem having an outer radial surface with an annular groove formed therein, wherein the valve stem is adjustable between an open position and a closed position;

a spring retainer spaced apart from the valve body along a longitudinal axis of the valve stem and fixed relative to the valve body, the spring retainer defining a bore through which the valve stem extends;

a valve spring captured between the valve body and the spring retainer and configured to apply a biasing force to the valve stem that biases the valve stem toward the closed position;

a valve seal attached to the valve body and engaging the outer radial surface of the valve stem; and a garter spring engaging an outer radial surface of the valve seal and extending around a circumference thereof, the garter spring biasing the valve seal into engagement with the annular groove in the valve stem, the engagement between the valve seal and the annular groove inhibiting movement of the valve stem from the closed position toward the open position.

18. The valve assembly of claim 17 wherein the valve seal includes:

a seal body attached to an axial end surface of the valve body and disposed about a circumference of the valve stem; and a seal lip attached to an inner radial surface of the seal body, projecting radially inward therefrom, and engaging the outer radial surface of the valve stem, wherein the garter spring engages the outer radial surface of the seal lip.

* * * * *